US006244146B1

(12) United States Patent
Arthur et al.

(10) Patent No.: US 6,244,146 B1
(45) Date of Patent: Jun. 12, 2001

(54) METHOD AND APPARATUS FOR SHEARING TABLETS

(75) Inventors: Anne Frances Arthur, Kalamazoo; Douglas Jay Dehaan, Portage; Clifford R. Jepsen, Mendon; Phillip F. Ni, Mattawan; Donald L. Vermeulen, Portage; Edward A. Witkoske, Plainwell, all of MI (US)

(73) Assignee: Pharmacia & Upjohn Company, Kalamazoo, MI (US)

( * ) Notice: Subject to any disclaimer, the term of this patent is extended or adjusted under 35 U.S.C. 154(b) by 0 days.

(21) Appl. No.: 09/487,085

(22) Filed: Jan. 19, 2000

Related U.S. Application Data

(60) Provisional application No. 60/119,497, filed on Feb. 10, 1999.

(51) Int. Cl.[7] ..... B26D 7/00

(52) U.S. Cl. ..... 83/23; 83/157; 83/167; 83/932

(58) Field of Search ..... 225/103; 83/196, 83/198, 199, 200, 23, 157, 167, 932

(56) References Cited

U.S. PATENT DOCUMENTS

| | | | | |
|---|---|---|---|---|
| 771,752 | * | 10/1904 | Stafford . | |
| 2,655,259 | * | 10/1953 | Davoren . | |
| 3,252,364 | * | 5/1966 | Veres et al. . | |
| 3,451,297 | * | 6/1969 | Reis et al. . | |
| 3,567,088 | * | 3/1971 | Andersen | 225/103 |
| 4,173,826 | | 11/1979 | Leopoldi et al. | 30/124 |
| 4,179,806 | | 12/1979 | Lieptz | 30/124 |
| 4,361,174 | * | 11/1982 | Jenkins et al. | 140/140 |
| 4,697,344 | | 10/1987 | Leopoldi | 30/124 |
| 4,911,046 | | 3/1990 | Goss et al. | 83/198 |
| 4,964,555 | | 10/1990 | Hnatuk | 225/93 |

OTHER PUBLICATIONS

Michael Glover & Denis Cooper, Packaging tablets for clinical trials, Jun., 1990, p. 26.

* cited by examiner

*Primary Examiner*—Rinaldi I. Rada
*Assistant Examiner*—Melissa L Hall
(74) *Attorney, Agent, or Firm*—Flynn, Thiel, Boutell & Tanis, P.C.

(57) ABSTRACT

A tablet shearing apparatus includes a support frame comprising a top frame member having an opening, a stationary plate secured to the top frame member. The stationary plate includes apertures extending about substantially the entirety of the opening of the top frame member. A movable plate including apertures is disposed above the stationary plate. A drive cylinder is connected through a linkage arm and an actuator arm to the movable plate. A tablet tray having apertures for receiving tablets can be positioned above the movable plate to transfer tablets to the apertures of the movable plate and the stationary plate so that, when individual tablets are supported in the apertures of both the stationary plate and the movable plate, the drive cylinder moves the movable plate relative to the stationary plate and shears the tablets. The tablet shearing apparatus also includes a tablet release gate having keyhole shaped apertures. A wide end of the keyhole shaped apertures enables tablet portions to fall through after movement of the release plate to an appropriate position. A narrow end of the keyhole shaped apertures support respective tablets in an upright position before shearing of the tablets.

23 Claims, 7 Drawing Sheets

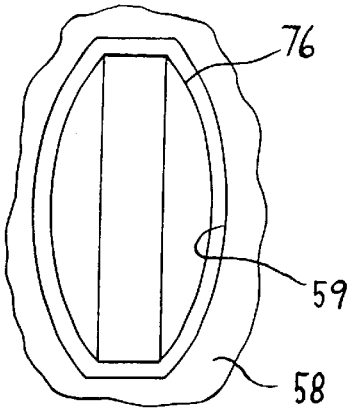
FIG. 8
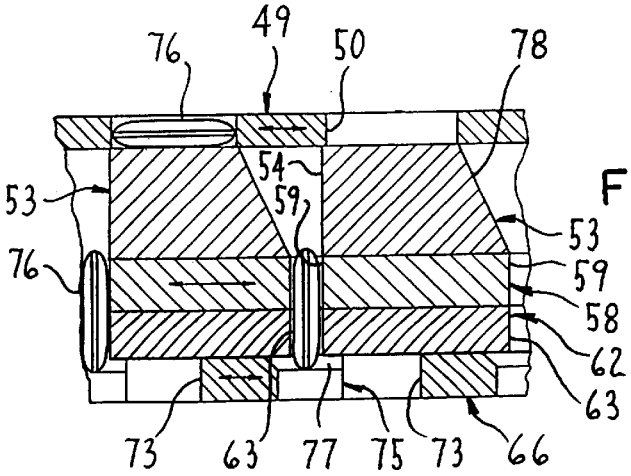
FIG. 9
FIG. 10
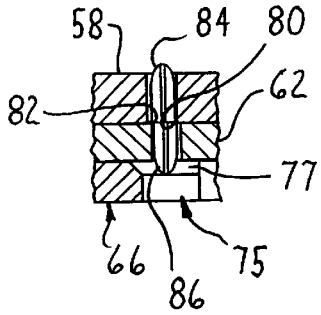
FIG. 11
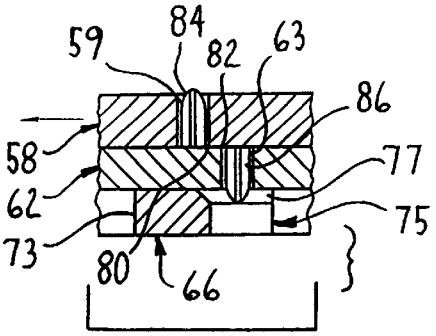
FIG. 12
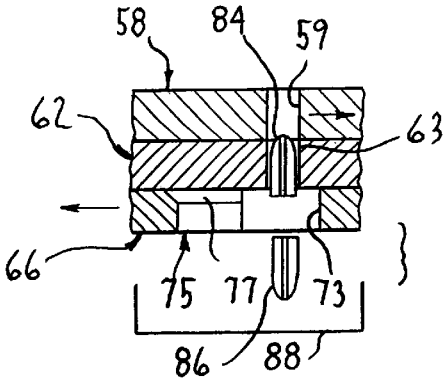

METHOD AND APPARATUS FOR SHEARING TABLETS

This application claims benefit to U.S. provisional application Serial No. 60/119,497 filed Feb. 10, 1999.

FIELD OF THE INVENTION

This invention relates to methods and apparatus for shearing a large quantity of tablets into two approximately equal sized parts in an accurate and quick manner.

BACKGROUND OF THE INVENTION

It is common practice to utilize pill cutters or the like to cut tablets into approximately equal parts. Representative prior art devices are known from U.S. Pat. Nos. 4,173,826, 4,173,806 and 4,964,555 and an article in the June, 1990 issue of *Manufacturing Chemist* entitled "Packaging tablets for clinical trials," by Messrs. M. Glover and D. Cooper (Vol. 61, page 26). In drug trials, especially drug interaction trials, large quantities of drug tablets must be cut and placed in capsules. Cutting tablets with conventional devices takes an inordinate amount of time. Further, the work is monotonous which can lead to errors or mistakes.

In U.S. Pat. No. 4,697,344 to Leopoldi, a plurality of pills are placed in pockets of a pad. Knife blades in the pockets cut the pills when a top member is placed over the pockets and manually forced downward. The pill cutter relies on the knife blades to cut the pills and no movable plates are utilized.

This invention makes shearing a large quantity of tablets into substantially equal sized portions fast and convenient and by structure that is inexpensive and yet durable and very accurate.

SUMMARY OF THE INVENTION

The tablet shearing apparatus of the invention generally includes a support frame having a top frame member with an opening therein, a stationary plate secured to the top frame member and including apertures extending about substantially the entirety of the opening of said top frame member, a movable plate including apertures positioned above the stationary plate and being supported such that the movable plate can only move in directions along a path, and a tablet tray having apertures for receiving tablets. The tablet tray generally is positionable above the movable plate to transfer tablets to the apertures of the movable plate and stationary plate. When individual tablets are supported in the apertures of both the stationary plate and the movable plate, movement of the movable plate relative to the stationary plate shears the tablets.

A method of the invention includes the steps of disposing a plurality of tablets on a tablet tray in a flat position in apertures of the tablet tray, positioning the tablet tray on a support frame having a top frame member with an opening, and releasing the tablets through the apertures of the tablet tray and into apertures in a movable plate aligned with apertures in a stationary plate secured to the top frame member. The movable plate can be in surface-to-surface relationship with the stationary plate.

BRIEF DESCRIPTION OF THE DRAWINGS

Other objects and purposes of the invention will be apparent to persons familiar with devices of this general type upon reading the following specification and inspecting the accompanying drawings, in which:

FIG. 8 is a top view of one tablet received in the aligned apertures in the stationary and movable plates, the tablet being in a standing position;

FIG. 9 is an enlarged sectional view showing tablets in the tablet tray and in the tablet shearing apparatus;

FIG. 10 is an enlarged sectional view showing shearing of a tablet by the movable plate and the stationary plate;

FIG. 11 is an enlarged sectional view showing the arrangement of tablet portions after shearing occurs; and FIG. 12 is an enlarged sectional view showing release of tablet portions by the tablet release gate.

Figure 1:
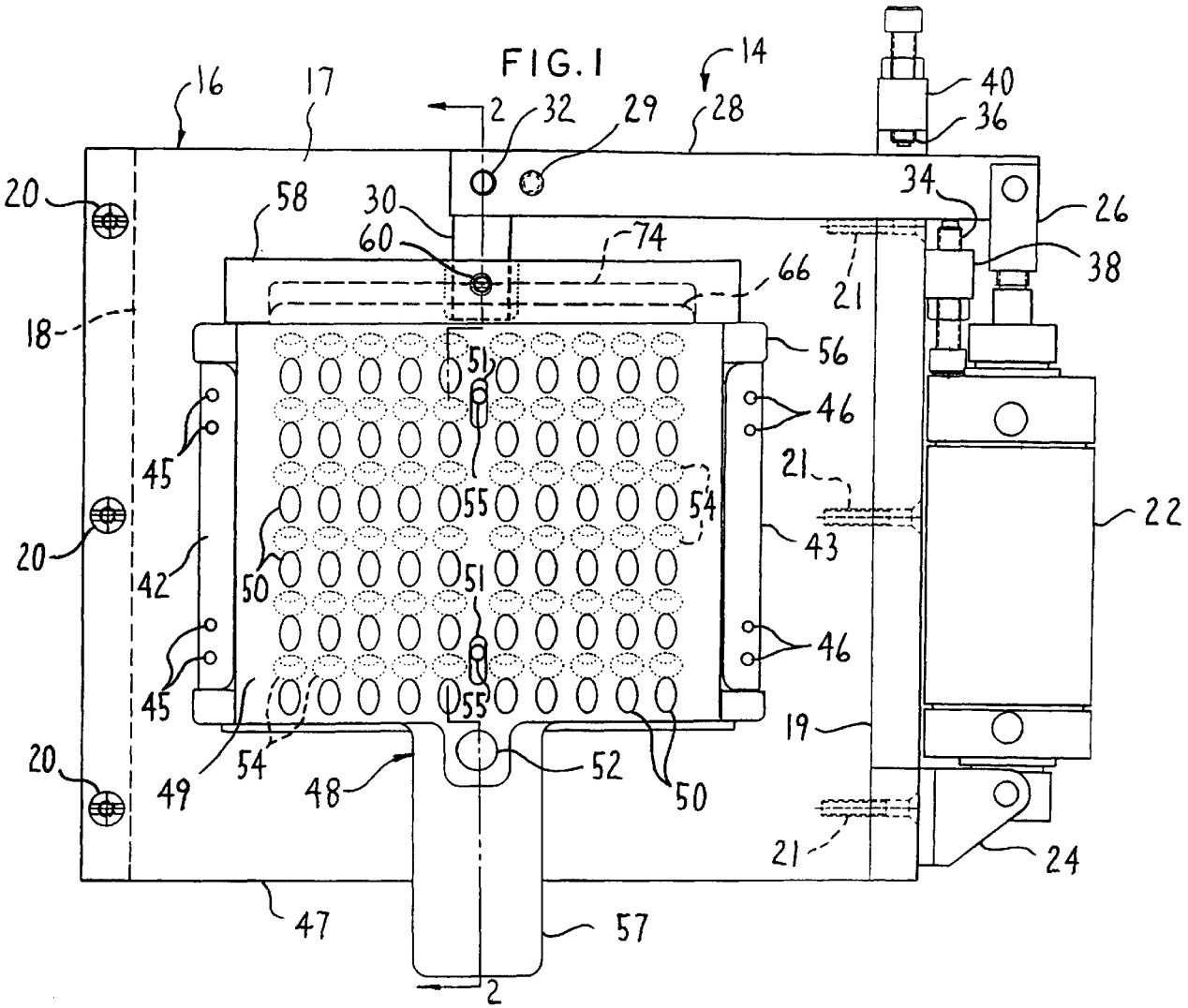
FIG. 1 is a top view of a tablet shearing apparatus according to the present invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the tablet shearing apparatus and designated parts thereof. Such terminology will include derivatives and words of similar import.

DETAILED DESCRIPTION

Referring to the drawings and specifically FIGS. 1–12, there is illustrated a tablet shearing apparatus 14, and components thereof, for shearing tablets according to the present invention. The tablet shearing apparatus 14 of FIG. 1 includes a support frame 16 having a top frame member 17, a first side frame member 18 and a second side frame member 19. Metal screws 20 secure the top frame member 17 to the first side frame member 18. Likewise, metal screws 21 secure the second side frame member 19 to the top frame member 17 to form an inverted U-shaped frame 16.

The tablet shearing apparatus 14 of FIG. 1 also includes a drive cylinder 22 mounted to the side frame member 19 by a drive cylinder support 24 and other elements. A drive cylinder linking member 26 connects a reciprocal output member of the drive cylinder 22 to one end of a linking arm 28 pivotally secured at an intermediate location therein to the frame as at 29. The linking arm 28 is pivotally secured at the other end thereof to an actuator arm 30 by a fastener element, such as a pin 32. Stop elements 34, 36 limit movement of the linking arm 28. Respective stop support elements 38, 40, shown in FIGS. 1 and 4, support the stop elements 34, 36 on the frame 16 at appropriate locations adjacent the linking arm 28.

Figure 5:
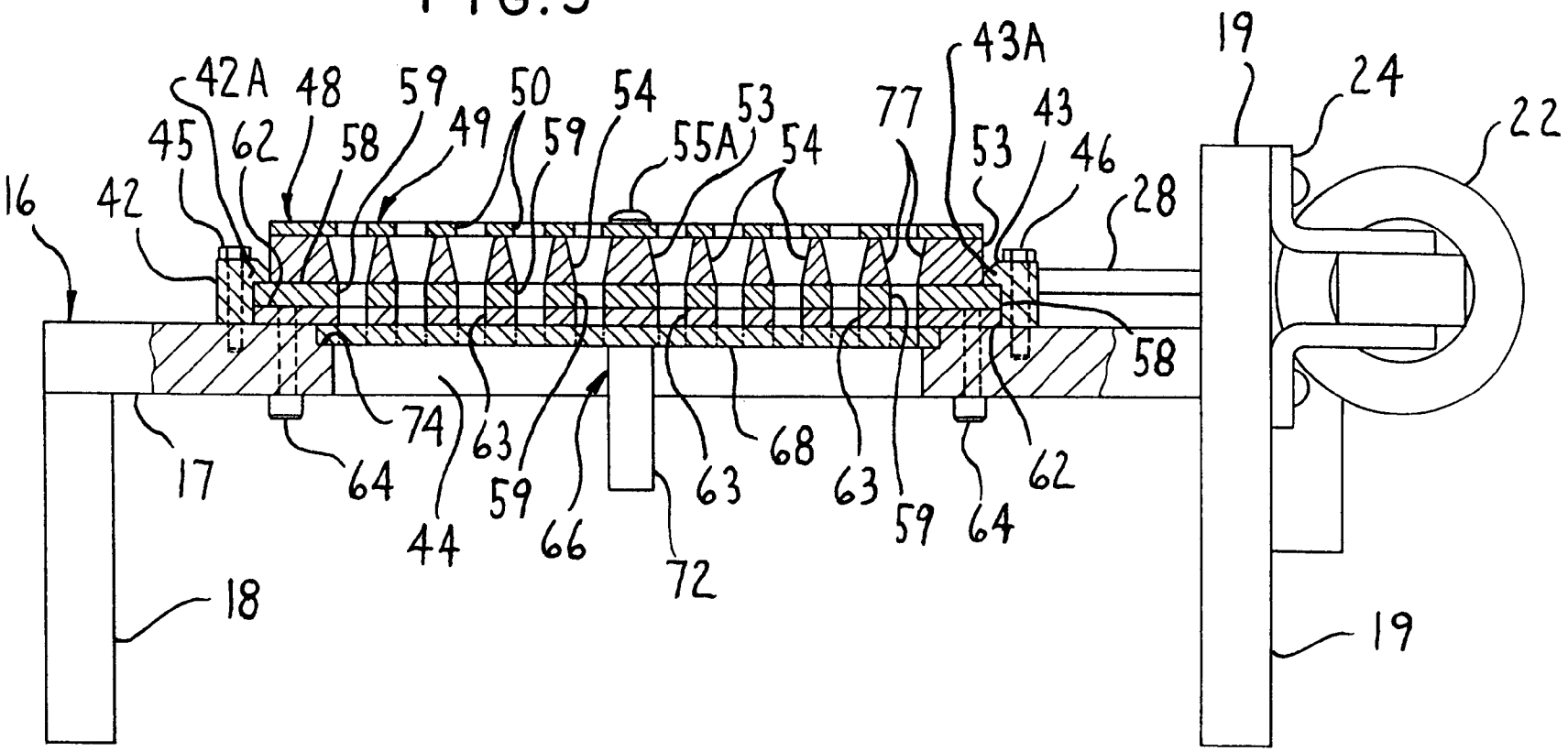
FIG. 5 is a partial cross-sectional view taken along the line 5—5 of FIG. 2 and showing the relationship of the flanges to the stationary plate and the movable plate.

As shown in FIG. 5, guide members 42, 43 are mounted at opposing sides of a rectangular through opening 44 in top frame member 17 by bolts 45, 46. The guide members 42, 43 each include a respective top flange part 42A and 43A extending inwardly to overlay and retain plate elements described in more detail below.

A tablet tray 48 (FIG. 7) includes a top tray member 49 having plural apertures 50 and elongate slots 51. The top tray member 49 also has a finger aperture 52 enabling movement of the top tray member along a path created by slots 51. A base tray member 53 of the tablet tray 48 includes plural base tray apertures 54, upwardly projecting pin elements 55, side legs 56, and a base tray handle 57. The side legs 56 straddle the ends of the guide members 42, 43 such that the base tray member 53 is properly aligned with the frame 16. The base tray handle 57 enables easy removal and placement of the tablet tray 48 on tablet on the frame 16. The top tray member 49 is slidably movable along a path between the guide members 42, 43. The pin elements 55 projecting from the base tray member 53 are received in the slots 51 of the top tray member 49 to thereby limit the amount and directions of movement of the top tray member 49 relative to the base tray member 53. An enlarged head 55A (FIG. 5) can, if desired, be provided on the upper end of the pin 55 to prevent the top tray member 49 from lifting of the base tray member 53.

Figure 2:
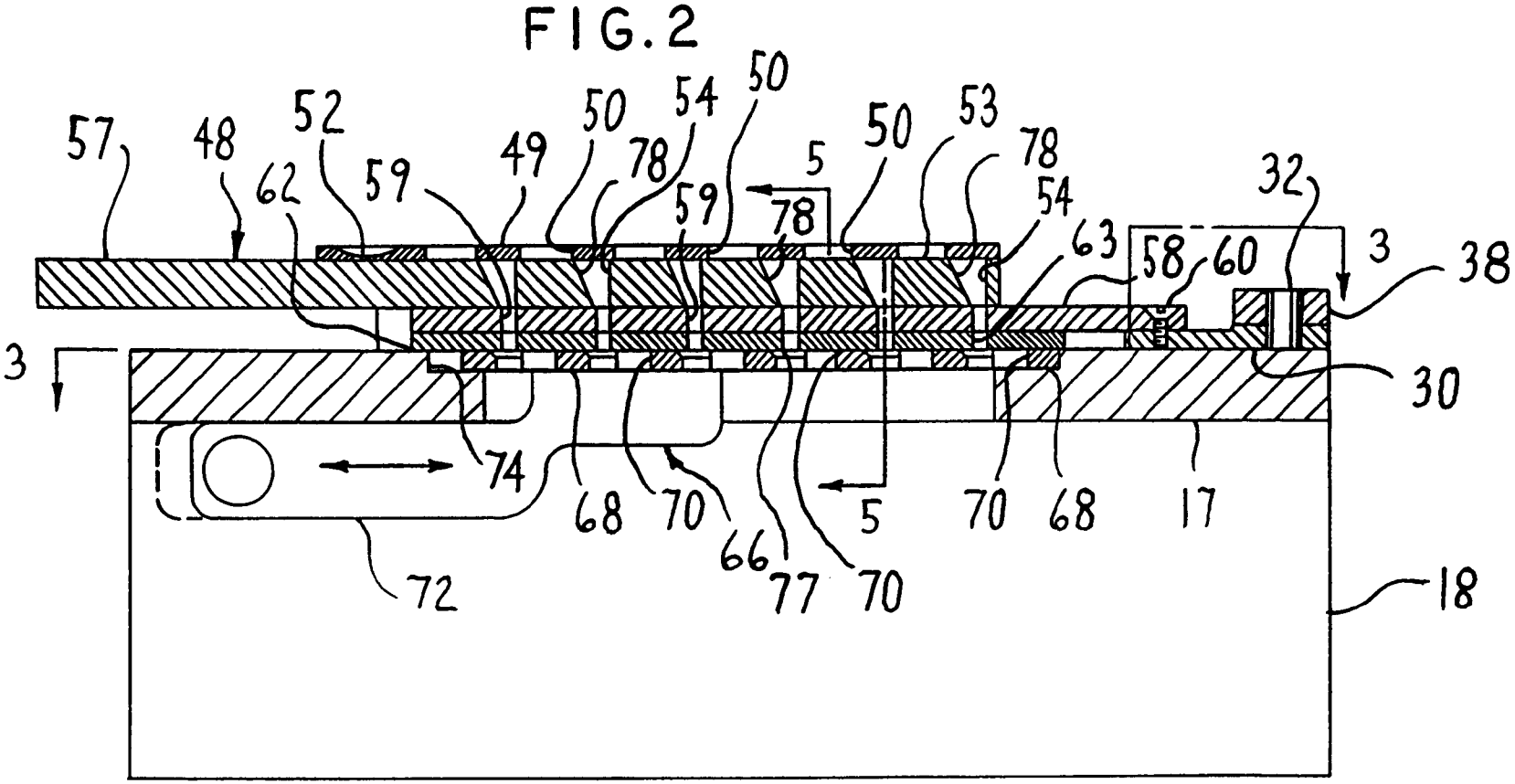
FIG. 2 is a cross-sectional view of the tablet shearing apparatus taken along the line 2—2 of the view of FIG. 1.

The tablet shearing apparatus 14 also includes a movable plate 58 having plural apertures 59 therethrough and secured to the actuator arm 30 by a fastener element 60 as shown in FIGS. 1 and 2. As illustrated in FIGS. 1, 2 and 5, the drive cylinder 22, through the linkage elements 26, 28, 30, slidably moves the movable plate 58 along a path parallel to the lengths of guide members 42, 43. The guide members 42, 43 maintain the movable plate 58 therebetween, as shown in FIG. 5, and thus guide the movable plate along the path in directions toward or away from the front 47 of the table shearing apparatus 14.

The tablet shearing apparatus 14 includes a stationary plate 62 having plural apertures 63 therethrough as shown in FIGS. 2 and 5. Fastener elements 64 fixedly secure the stationary plate 62 to the upper surface of the top frame member 17. The stationary plate 62 has a top surface in surface-to-surface relationship with a bottom surface of the movable plate 58. The movable plate 58 can slide along a path across the top surface of the stationary plate 62 when actuated by the drive cylinder 22.

Both of the movable plate 58 and the stationary plate 62 are oriented to overlay the opening 44 through the top frame member 17 as shown in FIGS. 2 and 5. Further, each of the apertures 59 and 63 are oriented directly above the opening 44.

The tablet shearing apparatus 14 also includes a tablet release gate 66. The tablet release gate 66 includes a tablet release plate 68 having plural tablet release apertures 70 therethrough, and a tablet release handle 72. The tablet release plate 68 is disposed in a cut-out 74 formed in the top surface of the top frame member 17 about the circumference of the opening 44. The cut-out 74 enables the tablet release plate 68 to be firmly seated between guide members 42, 43, to prevent movement thereof side to side. However, the opening 44 and the cut-out 74 are sized in the direction of movement of the movable plate 58 and the tablet release plate 68 to enable movement of the tablet release plate 68 a predetermined distance sufficient to release tablets from tablet shearing apparatus 14 after the tablets have been sheared.

Figure 3:
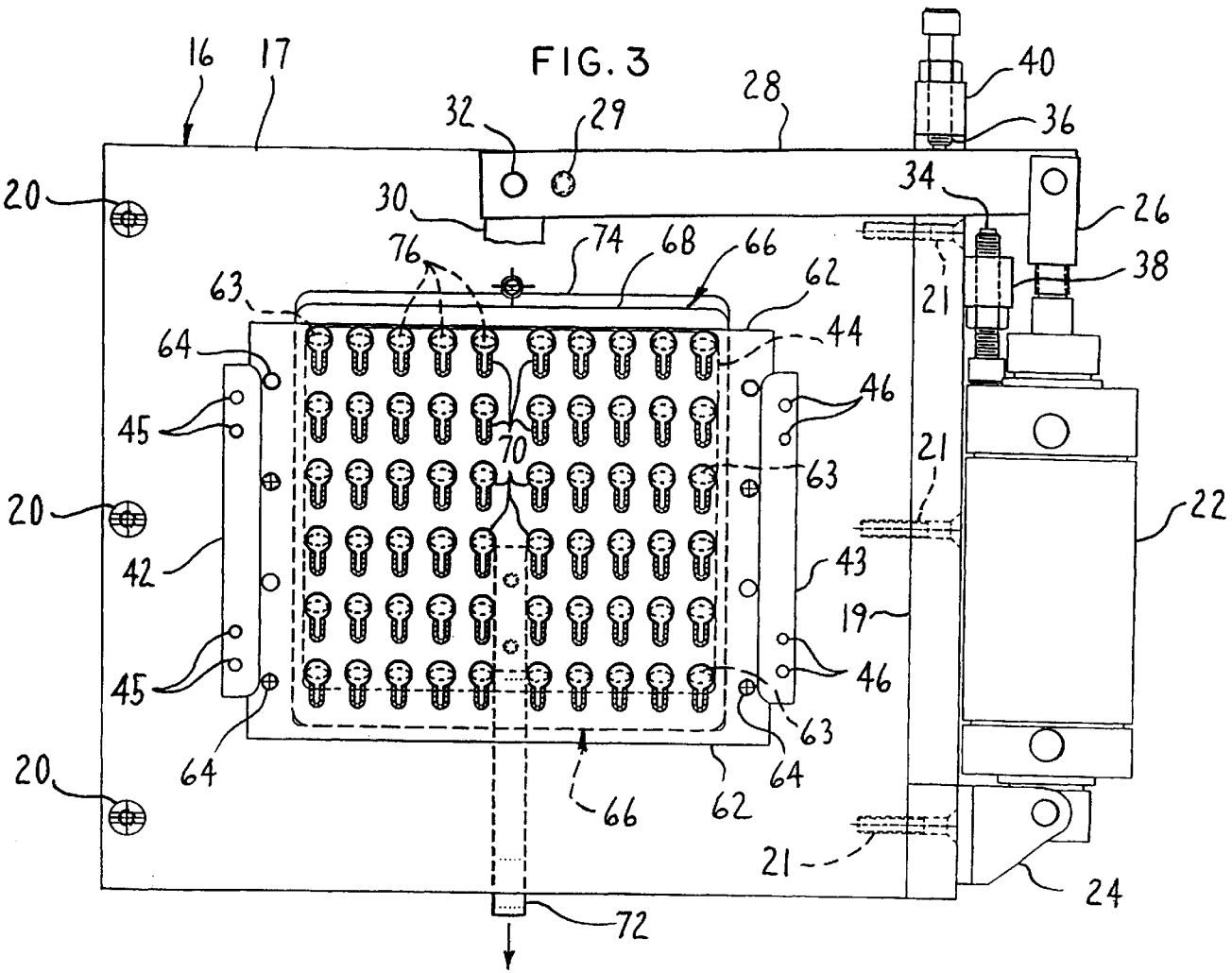
FIG. 3 is a top view of the tablet shearing apparatus with the tablet tray removed, the movable plate and stationary plate cut-away so as not to obscure the apertures in the tablet release gate.
Figure 4:
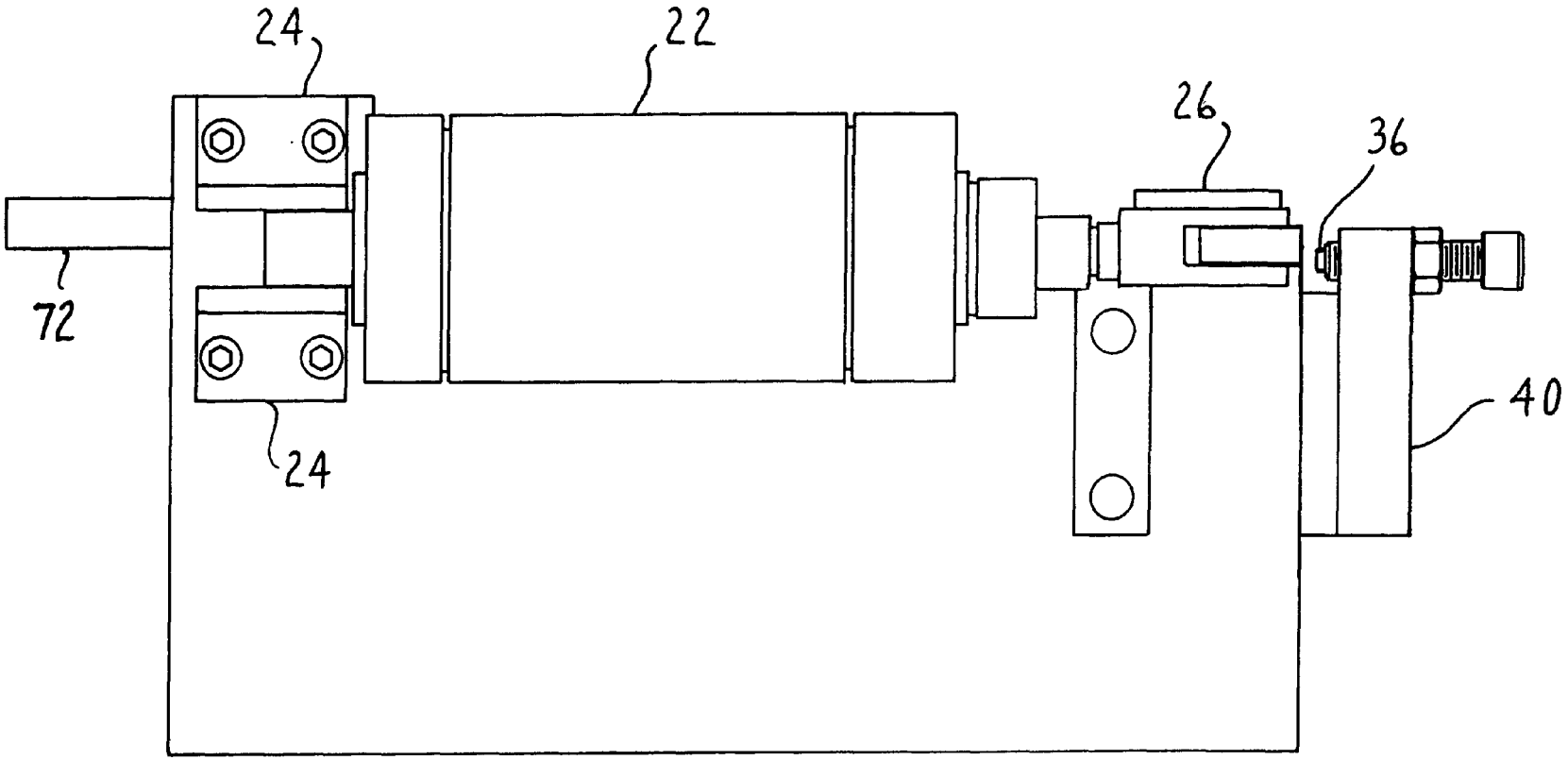
FIG. 4 is a right side view of the tablet shearing apparatus illustrated in FIG. 1 and illustrating the position of the drive cylinder.
Figure 6:
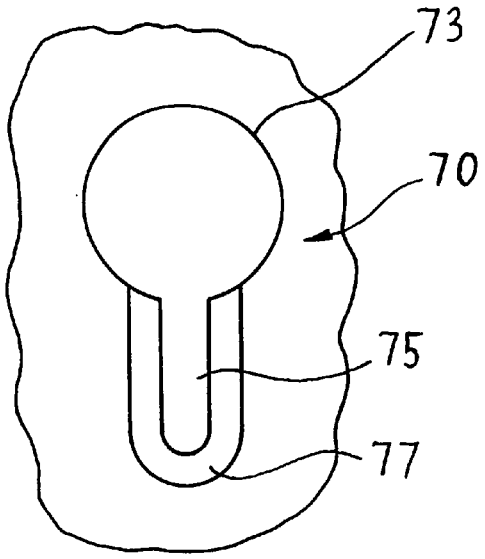
FIG. 6 is a top view of a keyhole shaped aperture 70 of the tablet release gate 66 shown in FIG. 3.
Figure 7:
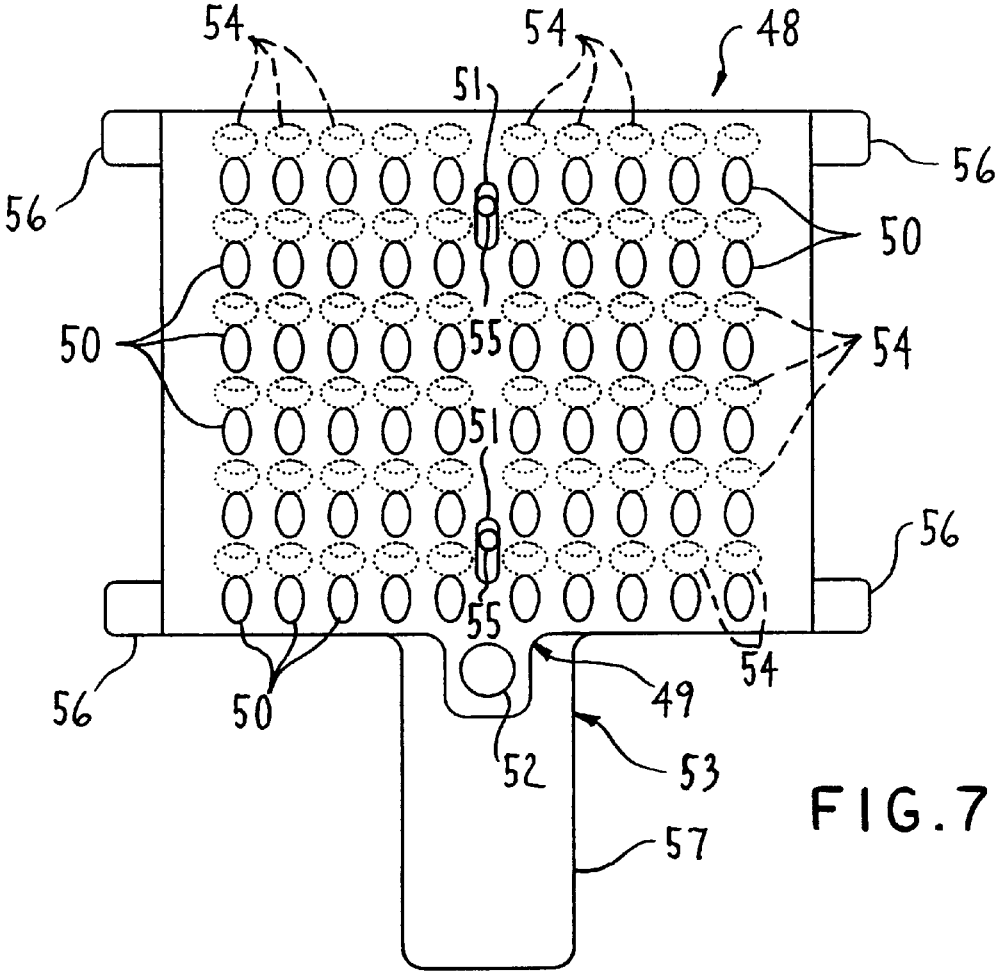
FIG. 7 is a top view of the tablet tray without the tablet shearing apparatus.

FIGS. 3 and 6 show a top view of the tablet release apertures 70 and their key hole shape. FIG. 3 also shows in dashed lines, tablets 76 in the release position of the tablet release plate 68. The key hole shape apertures 70 have a first end having a wide part 73 to release tablet portions through the wide part of the aperture. The wide part of the key hole shape apertures 70 preferably has a cylindrical shape. The other end of the apertures 70 is a narrow part 75 with sloped or beveled sides 77 for receiving and supporting a tablet before shearing thereof.

In operation, the tablet tray 48 is carried by the handle 57 independently with respect to the tablet shearing apparatus, and carries a large amount of tablets. Tablets can be dropped onto the top of the tablet tray 48, or the tray can be manipulated to scoop up a number of tablets. The person loading the tablet tray 48 then moves or sweeps their rubber glove protected hand about the top surface of the tablet tray to ensure that the tablets are either properly seated in each of the top tray apertures 50 or removed from the tray. As better shown in FIG. 9, tablets 76 rest in the top tray apertures 50 in a flat position. Such a position enables easy placement of the tablets 76 into the apertures 50. For example, the tablets 76 can easily be swept into, or fall into top tray apertures 50 on their own accord.

The disposition of the base tray member 53 with respect to the top tray member 49 shown in FIG. 1 is better illustrated in FIG. 9. Apertures 50 of the top tray member 49 are aligned so that the apertures do not connect with the base tray apertures 54 of the base tray member 53. As shown in FIG. 9, the apertures 54 of the base tray member 53 have at least one sloped side 78 that preferably opens upwardly at an angle of at least about 45 degrees. The sloped side 78 forms a ramp, such that when the top tray member 49 is moved along the path defined by slots 51, using the finger aperture 52, to align the apertures 50 of the top tray member 49 with the apertures 54 of the base tray member 53, the tablets move onto sloped side 78, and slide downwardly into respective aligned apertures 59, 63 of the movable plate 58 and the stationary plate 62, respectively, in an upright position. In this manner, the tablet tray 48 assists in gathering tablets 76 and in placing the tablets in the tablet shearing apparatus 14 in an appropriate position.

Of course, for the tablet tray 48 to work correctly in placing tablets in the tablet shearing apparatus 14, there must be at least a temporary correspondence and alignment between the apertures 59 of the movable plate 58 and the apertures 63 of the stationary plate 62, as well as the apertures 54 of the base tray member 53 and the apertures 50 of the top tray member 49.

The top tray 48 is removed after the tablets 76 are properly placed in aligned apertures 59, 63 of the movable plate 58 and stationary plate 62, respectively. The person placing the tablets into the movable plate 58 and stationary plate 62 moves or sweeps their rubber glove protected hand about the top surface of the movable plate 58 to ensure tablets are seated correctly at a proper depth in the tablet release plate 68. The apertures 59 of the movable plate 58 generally have substantially the same diameter and dimensions as the apertures 63 of the stationary plate 62. The dimensions are designed so that the tablets 76 fit reasonably snugly in the aperture 59 and the corresponding aperture 63. Apertures 59 and 63 are both open bottomed apertures. To prevent the tablets 76 from falling through shearing apparatus 14 immediately, the tablet release plate 68 is disposed directly beneath the aperture 63 of the stationary plate 62.

The drive cylinder 22 actuates or moves the movable member 58 to shear the tablets 76 present in the aligned apertures 59, 63. The drive cylinder 22 generally comprises a fluid pressure cylinder using fluid pressure, preferably air, to drive the linkage elements and thus apply a force moving the movable plate 58 along a path to cause shearing of the tablets 76. Such actuation takes a short period of time and results in complete shearing or severing of a plurality of tablets. In some embodiments, element 29 in FIG. 1 comprises a pivot element. The pivot element can be a pin pivotally securing the linking arm 28 to the top frame member 17. In this manner, the linking arm can pivot about element 29 in response to movement caused by the drive cylinder 22. In this embodiment, fastener element 32 also allows the actuator arm 30 to pivot or rotate relative to the linking arm 28. Thus the movable plate 58 can slide toward and away from the front 47 of top frame member 17 without deviating from the path defined by the guide members 42, 43.

As shown in FIG. 10, the movable plate 58 has a sharp corner 80 at least at the bottom right side of the apertures 59 corresponding to the side of the apertures applying force to respective tablets 76. Likewise, the stationary plate 62 has a sharp corner 82 at least at the top left side of the apertures 63 corresponding to the side of the apertures applying a counterbalancing force to respective tablets 76 being sheared. The sharp corners 80, 82 are merely defined by the corner or edge not being rounded significantly. The sharp corners 80, 82 enable shearing of the tablets 76 without a cutting knife. Therefore, the tablet shearing apparatus 14 need not have a knife element to function properly in shearing the tablets 76.

As shown in FIG. 10, the operation of the drive cylinder 22 applies a force to frangible tablets 76 causing the tablets to shear along a centerline corresponding to the contact lines at the sharp corners 80, 82 of the respective plates. In this manner, the tablets are sheared at an exact location.

By shearing the tablets in such an exact manner, tablets 76 can be divided substantially equally, each tablet portion 84, 86 being substantially equal in weight and drug dosage. This is an improvement over past pill cutters that have inexact placement of the tablets and other potential error factors.

As shown in FIG. 11, upon shearing, the tablet portion 84 travels the full extent of movement of the movable plate 58. The tablet portion 84 then is returned to alignment with aperture 63 at the time the drive cylinder 22 is returned to the original position thereof. As shown in FIG. 12, the wide end of the key hole shape aperture 70 of the tablet release plate 68 can be moved to a position disposed in alignment with corresponding apertures 59, 63. Such alignment releases tablet portions 84, 86 into a schematically illustrated collection bin 88 or other container. The tablet portions 84, 86 can then be used for drug interaction tests or for other purposes.

In embodiments where the sizes and shapes of the tablets to be sheared vary from the tablet shown in FIG. 8, a top tray 48 having differently sized apertures, a movable plate 58 having differently sized apertures, a stationary plate having differently sized apertures, and a tablet release gate having differently sized apertures, can be utilized to perform the operations of the invention. The various apertures must be properly sized to function correctly. Therefore, other plates or the like are contemplated so that the invention functions with various shaped tablets.

Of course, the thickness of the plate 58, the stationary plate 62, and the tablet release gate 66 that contacts a bottom end of the tablet 76, must be proportional to the size of the tablets as well. Different plates having differently sized apertures and thicknesses are within the scope of the invention.

While FIG. 1 shows sixty apertures to receive tablets, generally the tablet shearing apparatus 14 is adapted to receive at least thirty tablets, and preferably at least fifty tablets, for shearing in an individual movement of the movable plate 58 during operation of the shearing apparatus.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An apparatus for shearing a plurality of tablets comprising:

a support frame comprising a top frame member having an opening;

a stationary plate secured to said top frame member, said stationary plate including apertures extending about substantially the entirety of the opening of said top frame member;

a movable plate including apertures disposed above said stationary plate, said movable plate being supported such that said movable plate can only move in directions along a path; and a tablet tray having apertures for receiving tablets, said tablet tray being positioned above said movable plate to transfer tablets to the apertures of said movable plate and said stationary plate;

whereby, when individual tablets are supported in the apertures of both said stationary plate and said movable plate, movement of said movable plate relative to said stationary plate shears the tablets.

2. The apparatus of claim 1, wherein said support frame further includes:

an arm secured to said movable plate;

a drive cylinder secured to said support frame, said cylinder being connected through said arm to said movable plate and utilizing fluid pressure to move said movable plate along the path; and a tablet release gate disposed below said stationary plate, said tablet release gate having apertures sized to enable tablet portions to fall through after movement of said release plate to an appropriate position.

3. The apparatus of claim 2, wherein said apertures of said tablet release gate have a key hole shape, a wide end of the keyhole shaped apertures enabling tablet portions to escape therethrough to a container below said tablet release gate and a narrow part of the keyhole shaped apertures enabling the tablets to be supported thereon in an upright position, before shearing, such that the centerline of the respective tablets corresponds to a plane where said movable plate and said stationary plate are in surface-to-surface relationship with each other.

4. The apparatus of claim 3, wherein said keyhole shaped apertures of said tablet release gate have a generally elliptical slope on both sides along the length of a narrow part of the keyhole shaped apertures.

5. The apparatus of claim 1, wherein said tablet tray includes a top tray member and a base tray member below said top tray member, said top tray member being arranged to slide on said base tray member, said top tray member of said tablet tray having apertures and said base tray member having corresponding apertures.

6. The apparatus of claim 5, wherein said apertures of said base tray member are sloped to enable the tablets to move from a horizontal position toward an upright position when released as a result of movement of said top tray member such that the apertures of said top tray member are disposed above the apertures of said base tray member.

7. The apparatus of claim 5, wherein said top tray member has at least fifty apertures.

8. The apparatus of claim 5, wherein said base tray member has the same number of apertures for containing tablets as said top tray member.

9. The apparatus of claim 5, wherein said apertures of said top tray 1 receive and support tablets in a flat position.

10. The apparatus of claim 1, wherein said stationary plate has the same number of apertures as said movable plate, the apertures of said stationary plate being equivalent in size and shape to the apertures of said movable plate.

11. The apparatus of claim 10, wherein said apertures of said movable plate are aligned with said apertures of said stationary plate before shearing of the tablets.

12. The apparatus of claim 1, wherein said apparatus further comprises flange members mounted at opposing sides of said top frame member adjacent said opening, said flange members supporting said movable plate such that said movable plate can move along the path, the path corresponding to lengths of said flange members.

13. The apparatus of claim 1, wherein said apertures of said stationary plate and said movable plate receive the tablets in a generally upright or standing position.

14. An apparatus for shearing a plurality of tablets, comprising:

a support frame comprising a top frame member having an opening;

a stationary plate having apertures secured to said top frame member, said stationary plate extending about substantially the entirety of the opening of said top frame member;

a movable plate having apertures and disposed above said stationary plate, said movable plate being supported such that said movable plate can be moved in directions along a path; and a tablet release gate disposed below said stationary plate, said tablet release gate having apertures sized to enable tablets to fall therethrough after movement of said tablet release plate to an appropriate position, whereby, when individual tablets are contained with the apertures of both said stationary plate and said movable plate, movement of said movable plate relative to said stationary plate shears the tablets.

15. The apparatus of claim 14, wherein said apparatus further comprising flange members mounted at opposing sides of said top frame member adjacent said opening, said flange members supporting said movable plate such that said movable plate can move along the path, the path corresponding to lengths of said flange members.

16. The apparatus of claim 14, wherein said apertures of said tablet release gate are keyhole shaped, a wide part of the keyhole shaped apertures releasing tablet portions and a narrow part of said keyhole shaped apertures supporting the tablets before shearing thereof.

17. A method of shearing a plurality of tablets comprising:

disposing a plurality of tablets on a tablet tray in a flat position in apertures of the tablet tray;

positioning the tablet tray on a support frame having a top frame member, the top frame member having an opening;

releasing the tablets through the apertures of the tablet tray and into apertures in a movable plate aligned with apertures in a stationary plate secured to the top frame member, the movable plate being disposed in surface-to-surface relationship with the stationary plate, the tablets being disposed in a generally standing position in the apertures of the movable plate and the stationary plate; and actuating the first movable plate in a direction parallel to the plane of the top frame member such that the tablets are each sheared into first and second portions by sharp corners of the apertures at the intersection of the movable plate and the stationary plate.

18. The method of claim 17, including moving a tablet release gate disposed below the stationary plate to release the tablet portions.

19. The method of claim 18, wherein the step of supporting the tablets in a generally standing position includes a supporting of a bottom end of the tablets on a curved aperture of the tablet release gate.

20. The method of claim 17, including the step of removing the tablet tray after releasing the tablets into the apertures of the movable plate.

21. The method of claim 17, including the step of manually sweeping across the top of the first moving plate to ensure the tablets are disposed at a proper depth therein before the step of moving the movable plate and shearing the tablets.

22. The method of claim 17, wherein said first and second tablets portions are substantially equal in size and weight.

23. The method of claim 17, wherein said step of disposing a plurality of tablets in apertures on the tablet tray including manually sweeping the tablet tray to ensure that tablets are disposed at flat positions in the apertures and excess tablets are removed.

* * * * *